US005879199A

United States Patent [19]

Belopolsky

[11] Patent Number: 5,879,199

[45] Date of Patent: Mar. 9, 1999

[54] MODULAR JACK ASSEMBLY AND UNIVERSAL HOUSING FOR USE THEREIN

[75] Inventor: Yakov Belopolsky, Harrisburg, Pa.

[73] Assignee: Berg Technology, Inc., Reno, Nev.

[21] Appl. No.: 607,971

[22] Filed: Feb. 29, 1996

[51] Int. Cl.[6] ..... H01R 13/502

[52] U.S. Cl. ..... 439/701; 439/676

[58] Field of Search ..... 439/676, 344, 439/650, 651, 620, 607, 701

[56] References Cited

U.S. PATENT DOCUMENTS

| | | | |
|---|---|---|---|
| 4,618,207 | 10/1986 | Silbernagel | 439/676 |
| 5,178,563 | 1/1993 | Reed | 439/676 |
| 5,362,257 | 11/1994 | Neal et al. | 439/676 |
| 5,364,294 | 11/1994 | Hatch et al. | 439/676 |
| 5,513,065 | 4/1996 | Caveney et al. | 439/620 |

FOREIGN PATENT DOCUMENTS

| | | | |
|---|---|---|---|
| 254510 | 8/1995 | Taiwan | H01R 9/09 |

*Primary Examiner*—Khiem Nguyen
*Assistant Examiner*—Yong Ki Kim
*Attorney, Agent, or Firm*—Daniel J. Long; M. Richard Page

[57] ABSTRACT

Disclosed is a modular jack assembly comprising an outer insulative housing having top and bottom walls and opposed lateral walls which define an interior section of the housing having front and rear open ends, and an insulated insert having a first section superimposed over the rear open end of the insulated housing and a second section extending generally perpendicular from the first section into the interior section of the housing. There are engagement points on both the top wall and the opposed lateral walls of the outer insulated housing. Latches may be positioned on the insulated insert on either their first section or their second section depending on the specific configuration of the insulated insert. If latches are positioned on the first section, the opposed lateral walls will be engaged. If latches are positioned on the top section, the top wall will be engaged. A common housing may, therefore, be used for a number of different types of insulated inserts.

14 Claims, 12 Drawing Sheets

MODULAR JACK ASSEMBLY AND UNIVERSAL HOUSING FOR USE THEREIN

BACKGROUND OF INVENTION

1. Field of the Invention

The present invention relates to electrical connectors and more particularly the modular gang jack connectors.

2. Brief Description Prior Developments

A variety of types of modular jacks are disclosed in the prior art. For example, the Electronics Industry Association and the Telecommunications Industry Association have established categories of modular jacks representing performance standards, e.g. category 3, category 4 and category 5. Various inductive filter designs and capacitive designs are also manufactured.

Such performance related characteristics may be reflected in the overall structure of the insulative insert for each type of modular jack, and a particular insulative housing will ordinarily be required to receive a particular type of insulative insert. Because of this limitation, only one type of insert may be employed with a particular type of housing. Furthermore, in multiple part housings, all the inserts will generally have to be of the same kind. A need, therefore, exists for a multiple jack assembly which will afford the user greater flexibility in the matching of inserts and housings.

SUMMARY OF THE INVENTION

In the modular jack assembly of the present invention, there is now an insulative housing which has a top and bottom wall and opposed lateral walls. These wall structures define an interior section which has front and rear open ends. The insulative housing is inserted from the rear open end so that it is superimposed over it and so that its front section extends perpendicularly toward the front open end. Means are provided on the housing so that the insulated insert may be engaged either at its first rear section or its second perpendicular section. By means of this configuration a common outer insulated housing can be used to receive a variety of different types of inserts such as category 4, category 5, inductive filters, or capacitive filters.

BRIEF DESCRIPTION OF THE DRAWINGS

The modular jack assembly of the present invention is further described with reference to the accompanying drawings in which.

DETAILED DESCRIPTION OF THE PREFERRED EMBODIMENT

Figure 1:
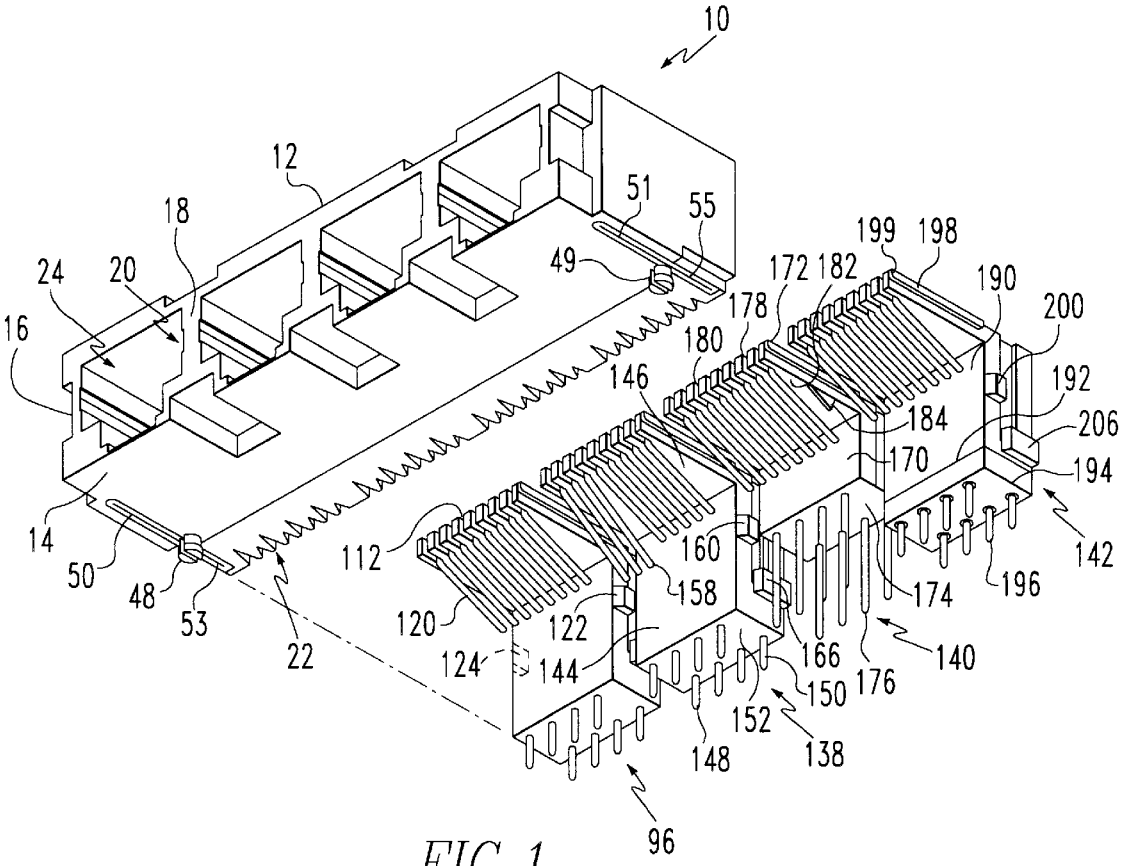
FIG. 1 is a perspective view of a preferred embodiment of the modular jack assembly of the present invention in which the insulated inserts are disengaged from the housing.
Figure 2:
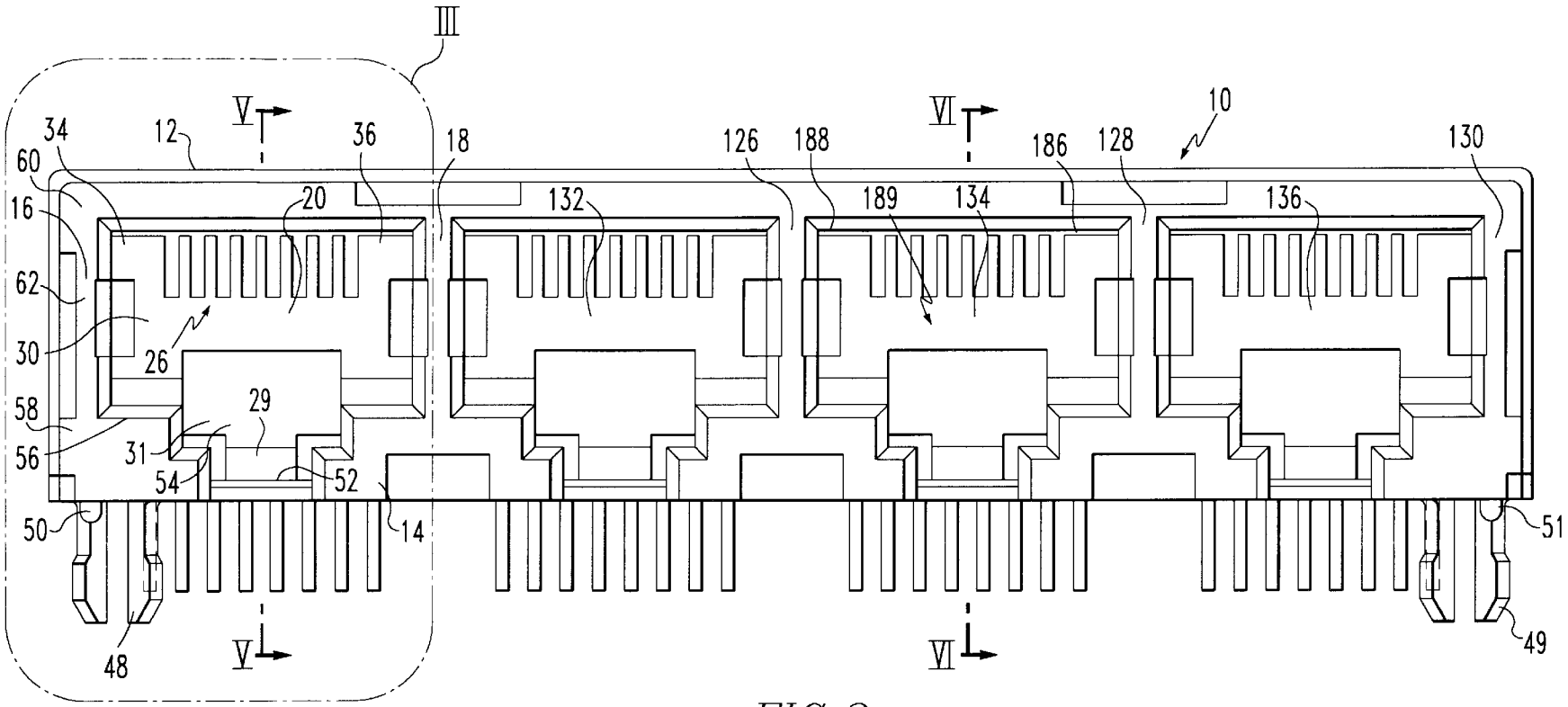
FIG. 2 is a front elevational view of the modular jack assembly shown in FIG. 1 in which inserts are engaged with the housing.
Figure 3:
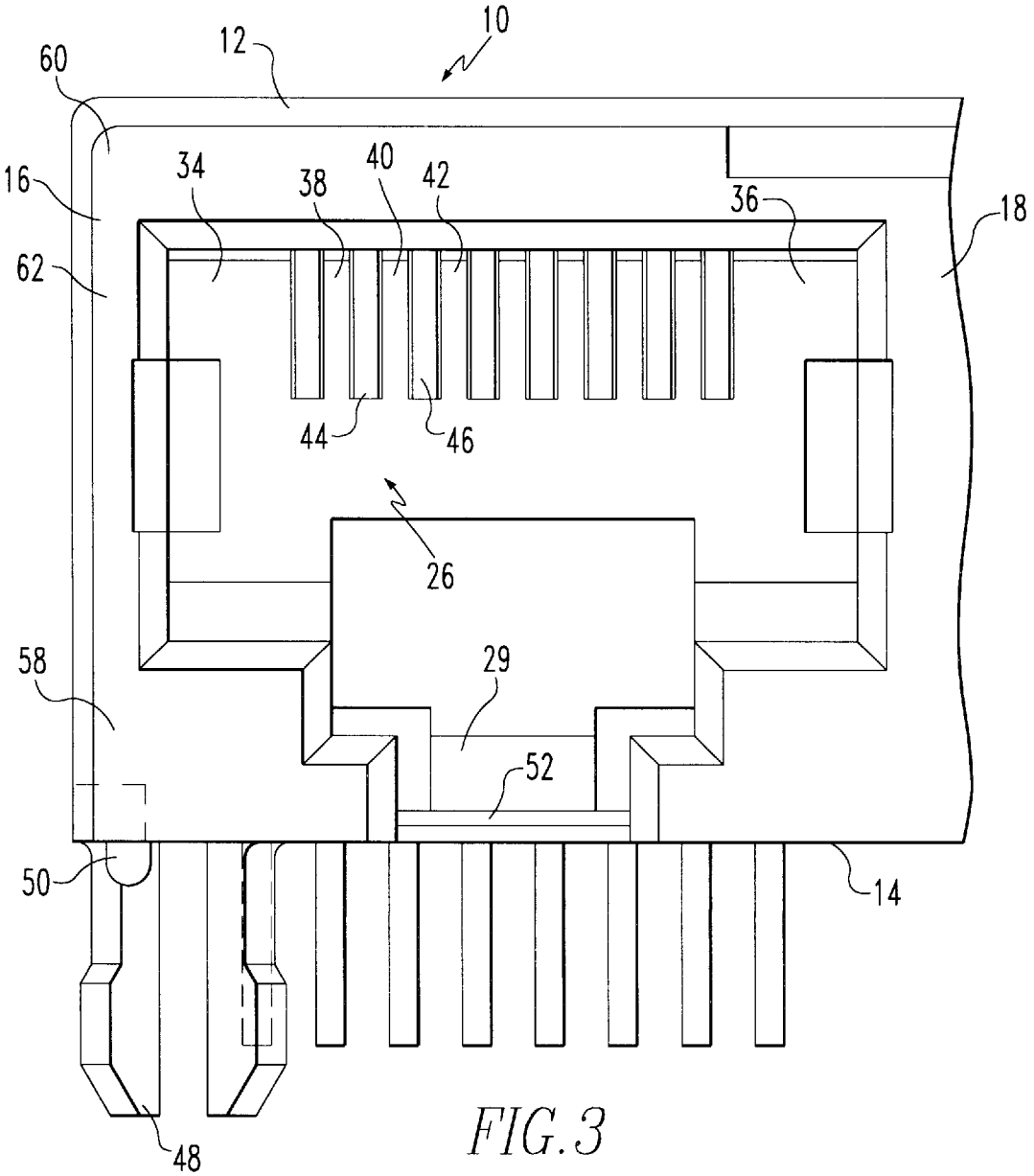
FIG. 3 is a detailed view of the area within circle III in FIG. 2.
Figure 4:
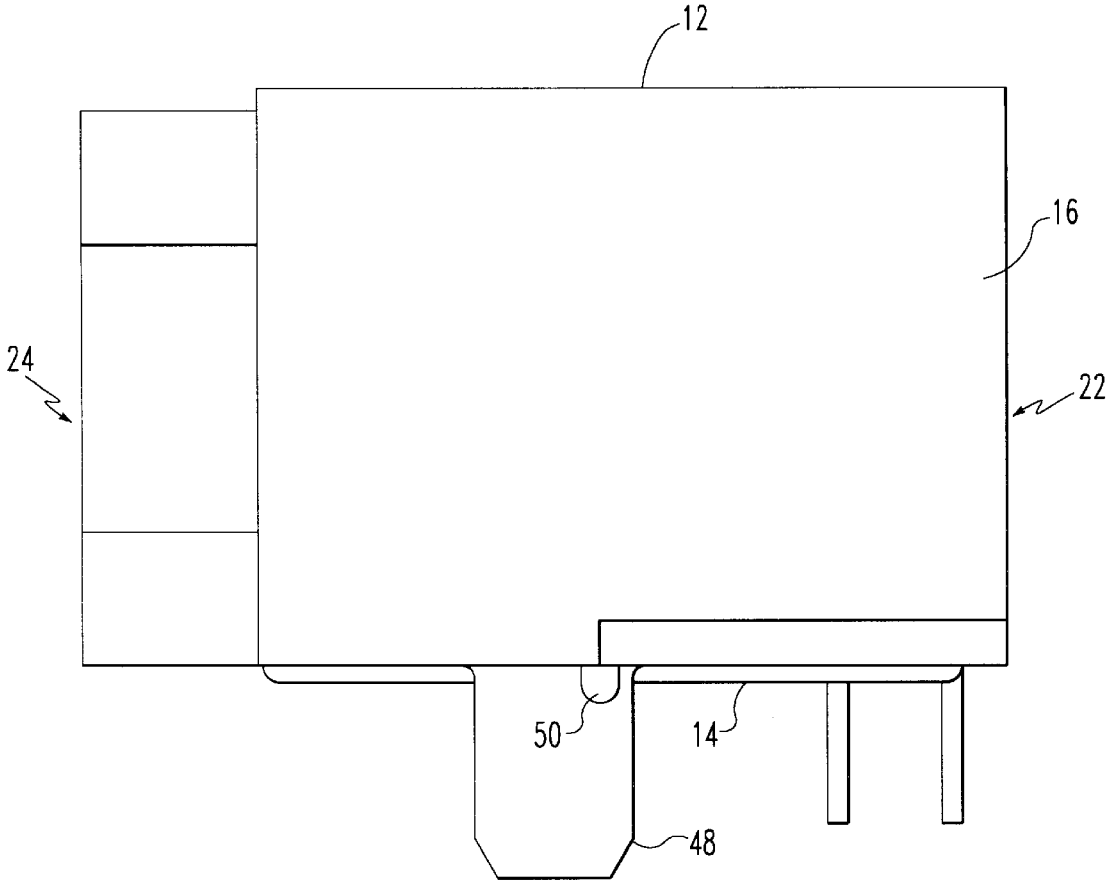
FIG. 4 is an end view of the modular jack assembly shown in FIG. 2.
Figure 5:
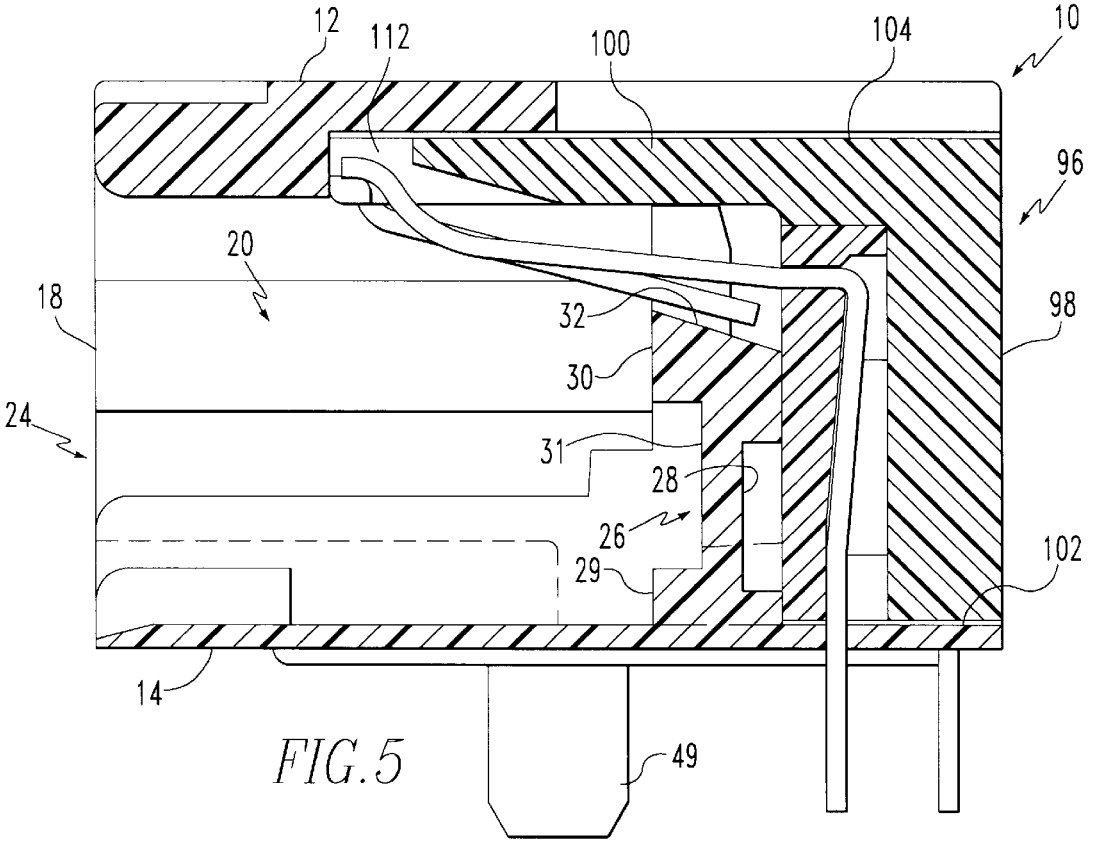
FIG. 5 is a cross sectional view through V—V in FIG. 2.
Figure 6:
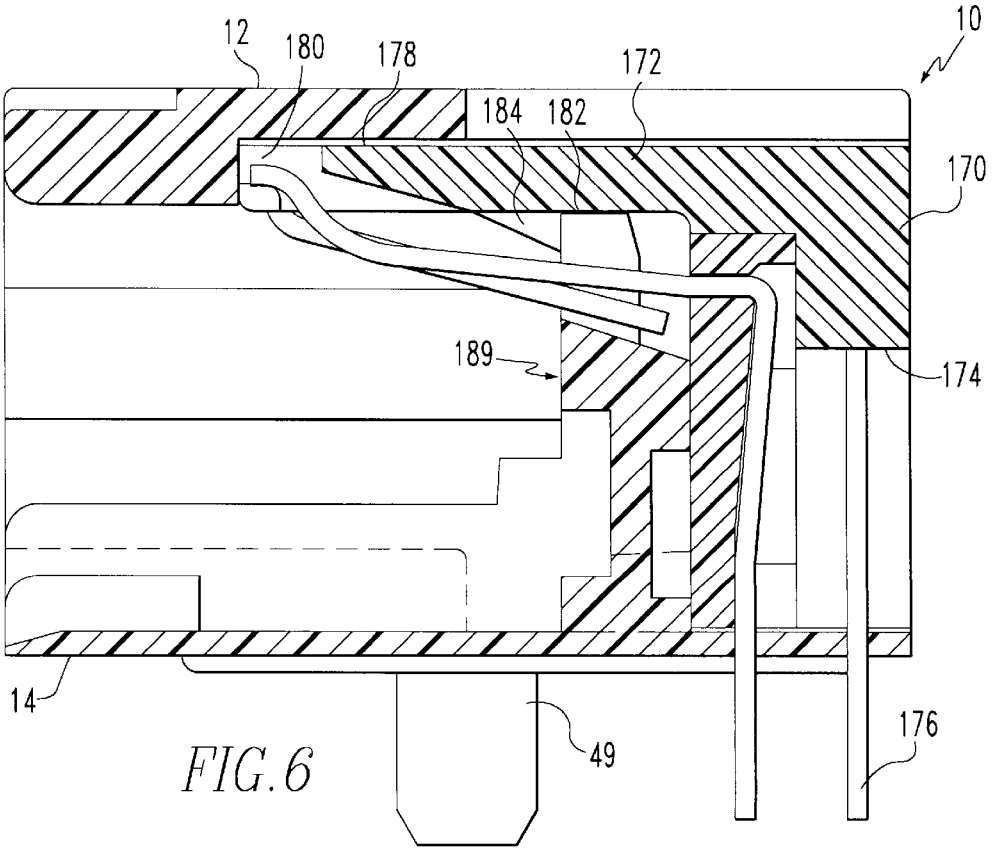
FIG. 6 is cross sectional view through VI—VI in FIG. 2.
Figure 7:
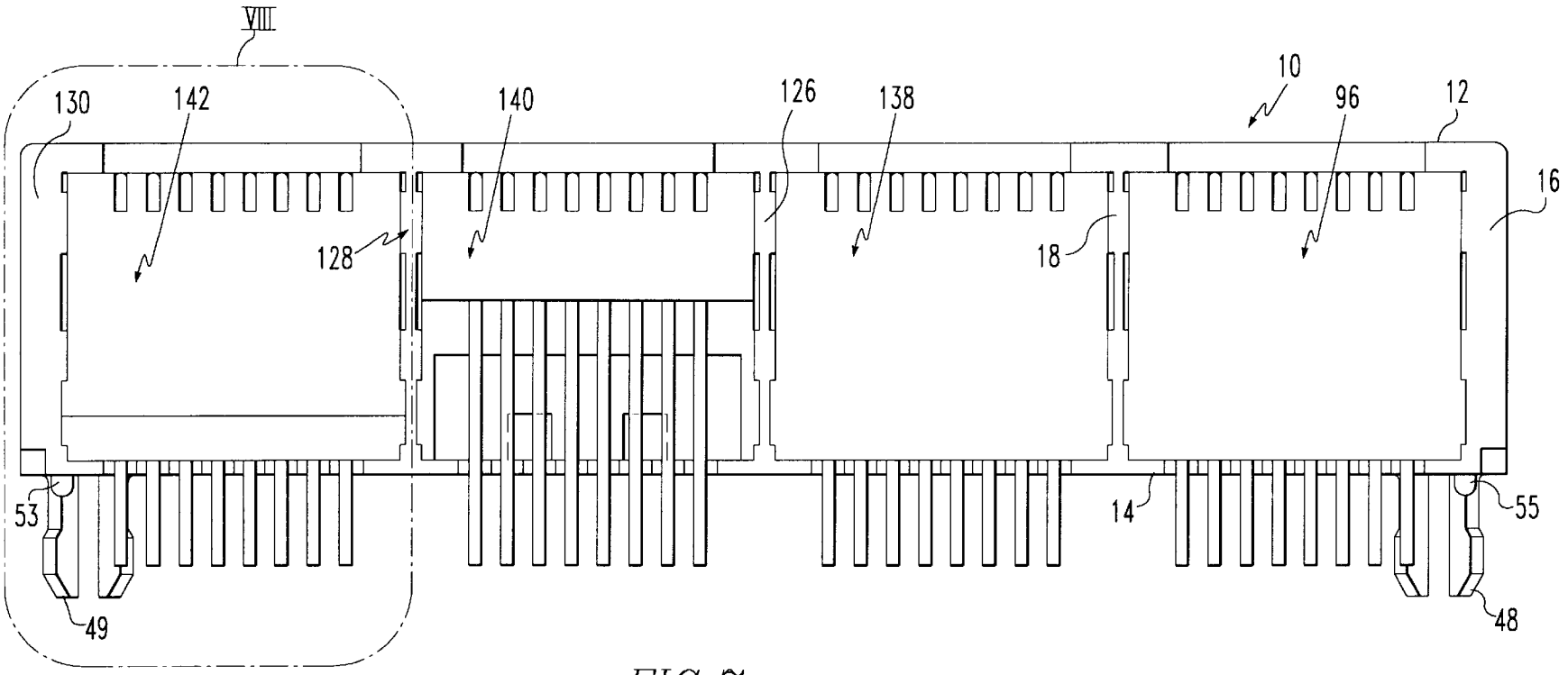
FIG. 7 is a rear elevational view of the modular jack assembly shown in FIG. 2.
Figure 8:
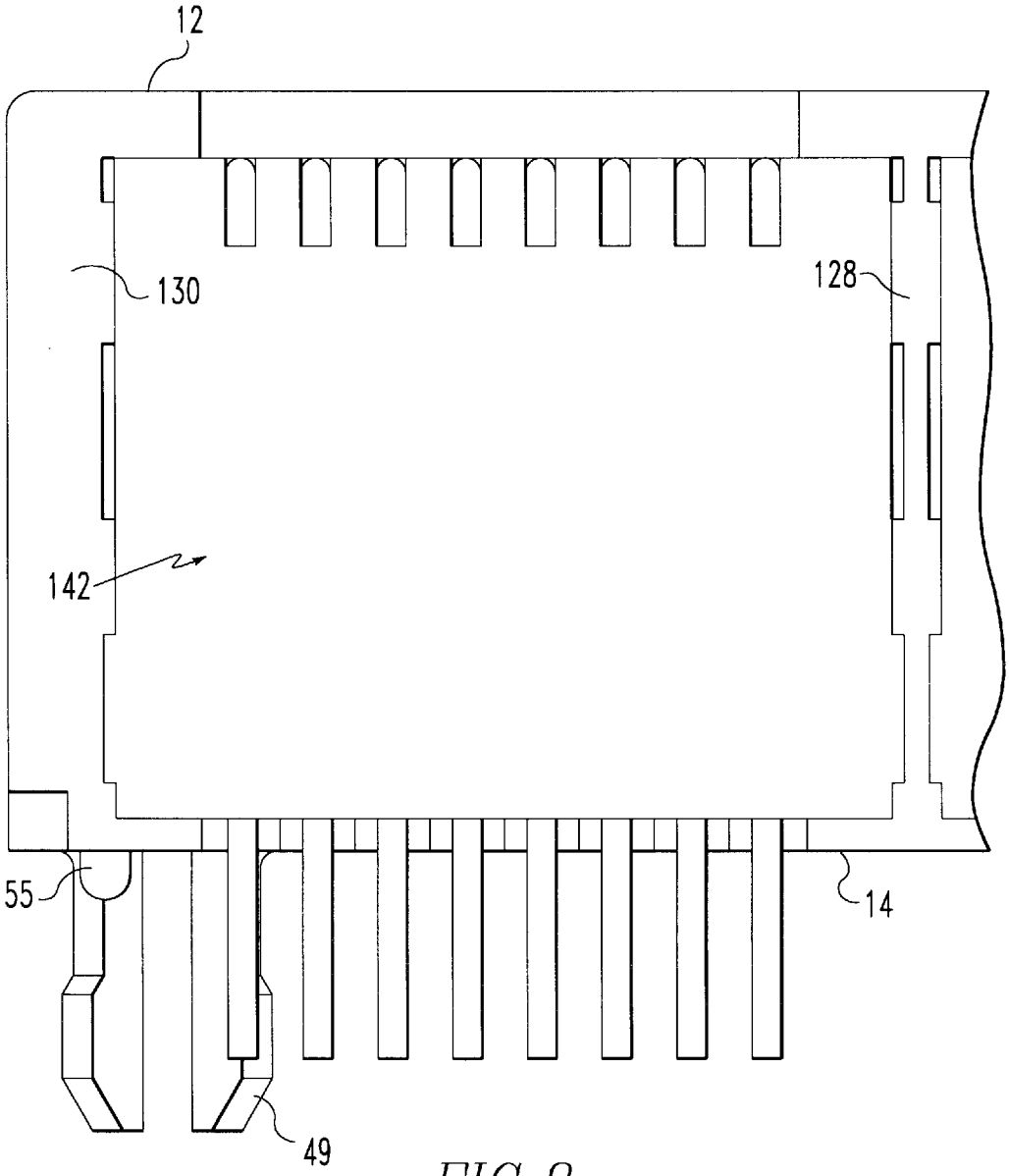
FIG. 8 is an enlarged view of the area within circle VII in FIG. 6.
Figure 9:
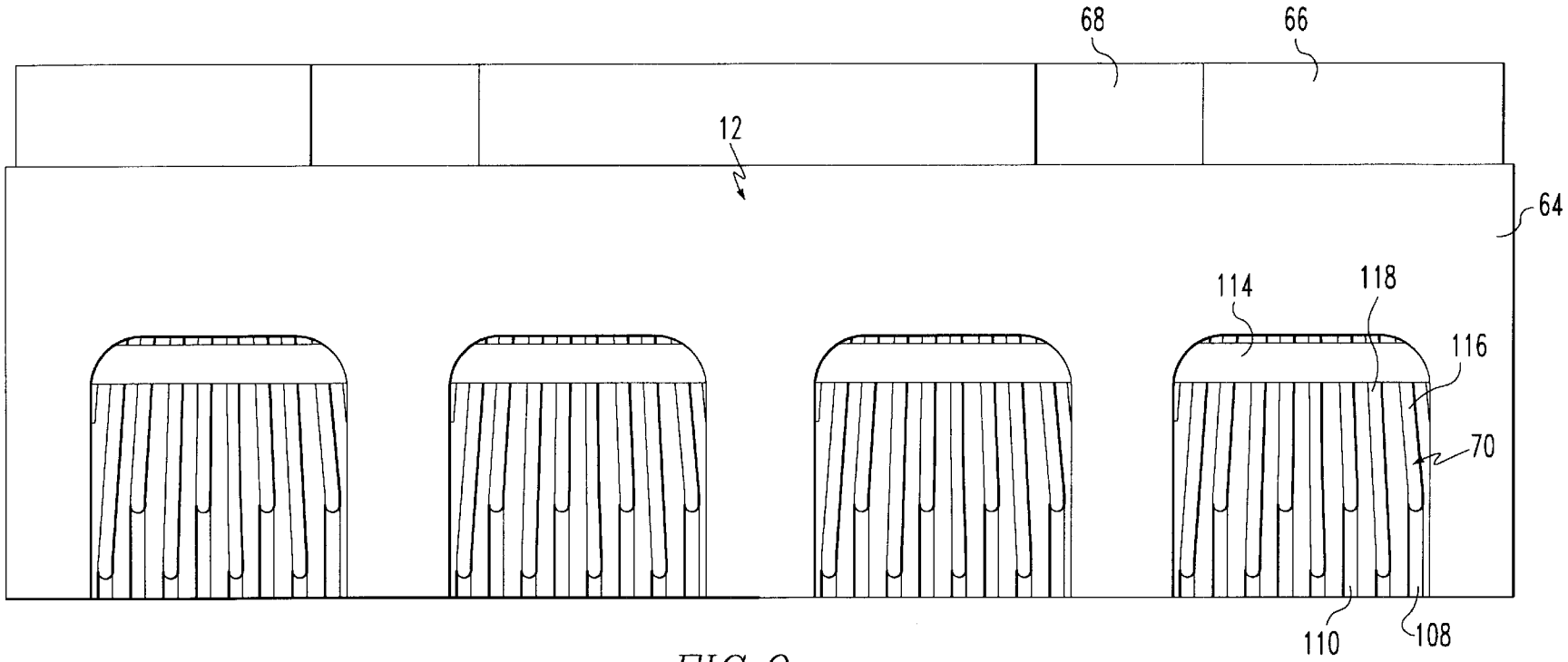
FIG. 9 is a top plan view of the modular jack assembly shown in FIG. 2.

Referring to the drawings, the outer insulative housing is shown generally at numeral 10. This housing includes a top wall 12, a bottom wall 14 and a pair of opposed lateral walls 16 and 18. The material from which the housing is constructed is a thermoplastic polymer having suitable insulative properties. Within these walls is an interior section 20 which has a rear open end 22 and a forward open end 24. Projecting upwardly from the bottom wall in this interior section there is a medial wall generally shown at numeral 26 which has a rear side 28 and a front side made up of a bottom front side 29, a top front side 30 and a recessed medial front side 31 and an inclined top side 32 which slopes upwardly and forwardly from its rear side toward its front side. Adjacent to the lateral walls, the medial wall has lateral extensions 34 and 36 which serve as projections to retain other elements as will be hereafter explained. Interposed between these lateral extensions there are a plurality of wire separation extensions as at 38, 40 and 42 and between these wire separation extensions there are plurality of slots at 44 and 46.

Extending downwardly from the bottom wall there are pins 48 and 49 and stand offs 50, 53 and 55. In the bottom wall of the insulative housing there is also a front groove 52. The lateral wall 16 includes a lower shoulder 54, another shoulder 56, a lower main wall 58, an upper main wall 60 and a recessed wall 62 interposed between the lower and upper main wall. It will be seen that the lateral wall 18 has substantially identical features as lateral wall 16. The top wall 12 includes an upper bridge section 64, a lower bridge section 66, a front recess 68 and a rear recess 70.

Figure 12:
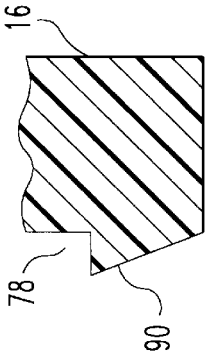
FIG. 12 is a cross section through XII—XII in FIG. 11.

From the rear side of the insulative insert there are on the inner sides of both of the lateral walls upper grooves 72 and 74, medial grooves 76 and 78 and lower grooves 80 and 82. On the upper grooves there are respectively upwardly projecting latches 84 and 86. On the medial groove there are respectively inwardly projecting latches 88 and 90. On the lower groove there are respectively upwardly projecting latches 92 and 94. It will be appreciated that all of the above mentioned latches are cross sectionally triangular as is shown, in particular in FIG. 12.

An insulative insert shown generally at 96 includes a vertical first section 98 and a top second section 100 which extends perpendicularly from the vertical section. The insulative insert also includes a base side 102 and upper side 104 and vertical bores (not shown) in the first section. The material from which the insulative insert is constructed is any thermoplastic polymer having suitable insulative properties. In the interior section of the housing the insert has a terminal end 106 and on its upper side there are a plurality of upper grooves as at 108 and 110 and at the terminal end there are a plurality of end grooves as at 112. An ultrasonically welded section 114 retains the wires in position. The conductive wires extend upwardly through bores in the vertical first section and bend to extend horizontally in the top grooves as in lateral sections 116 and 118. At the end of the grooves the wires bend downwardly to form a downward and rearward extension as at 120.

Means are also provided for fixing the insulative insert to the housing. In the preferred embodiment illustrated, these means comprise a pair of lateral latches 122 and 124 which project outwardly from opposite sides of the vertical first section to engage opposing latches 88 and 90 which are positioned respectively in the medial groove 76 and 78 in the insulative housing. A category 4 insert is commercially available, for example, from Berg electronics Group, Inc. of St. Louis, Mo. as part no. 94711.

There are also additional lateral walls 126, 128 and 130 which form interior sections 132, 134 and 136 for receiving additional insulative inserts in the housing. Referring particularly to FIGS. 1, 5, 6 and 11, it will be seen that in addition to the category 4 insulative insert shown generally at the numeral 96, three other types of inserts are engaged with the housing. The first of these inserts is a category 5 insulative insert shown generally at numeral 138 which is described in greater detail in U.S. patent application Ser. No. 08/346,640 filed Nov. 30, 1994, the contents of which are incorporated herein by reference. Such a category 5 insert is also commercially available, for example, from Berg Electronics Group, Inc. as part no. 95677. Another insert is an inductive filter insert 140 which is commercially available from Berg Electronics Group, Inc. as part no. 95677. Another insert is capacitive filter insert 142. The category 5 insert has a vertical first section 144 from which a top second section 146 projects perpendicularly into interior section 132. Conductive wires as at 148 and 150 extend upwardly from the base side 152 of the vertical first section through the vertical first section to the upper side 154 and then extends horizontally to the terminal end 156 of the top second section of the insert. As is typical of category 5 inserts, some end sections as at 158 extend sharply rearwardly from the terminal end while the others extends diagonally downwardly and rearwardly similar to the terminal ends of the wires in the category 4 insert. From the vertical first section of this insert there is a lateral projection 160 from one side and another projection (not shown) which extends in a similar position from the other side of the first section. These latching projections engage medial grooves as at 162 in lateral wall 126, and are fixed in those positions by projections as at 164 which extends from those grooves. There are also oppositely positioned lower lateral projections as at 166 which engage lower grooves as at 168 in the lateral walls, but are not locked into place with a projection similar to projection 164.

The ferrite inductive filter insert 140 also includes a vertical first section 170 and a top second section 172 which extends perpendicularly into the interior section of the housing from the vertical section. From a base surface 174 conductive wires as at 176 extend upwardly through the vertical first section to upper side 178 and from there extends horizontally to the terminal end 180 of the top second section and then extend diagonally downwardly and rearwardly towards the vertical base section. On the lower side 182 of the top second section of the insert there are downwardly projecting latches as at 184 which engage slots as at 186 and 188 between the medial wall 189 in the interior section of the housing and the top wall 12 of the housing. It will also be observed that the vertical first section of the low cost filter insert has no lateral latching projections, so that this insert is engaged to the housing solely by means of the downwardly projecting latches as at 184 which engage the slots as at 186 and 188.

The capacitive filter insert 142 has a vertical first section 190 and on its base side 192 there is a capacitor plate 194. Conductive wires as at 196 extend upwardly from this capacitor plate and base side through the vertical first section to the upper side 198 and then extend horizontally to the terminal end 199 and then extend rearwardly and downwardly back toward the vertical first section. In this insert there are medial lateral projections as at 200 which engage medial grooves as at 202 in the lateral walls and which are locked in such position by projections as at 204 in such medial grooves. Lower lateral projections as at 206 also engage lower grooves as at 208 in the lateral walls but, similar to the category 4 and category 5 inserts, are not engaged by a latching projection.

Figure 10:
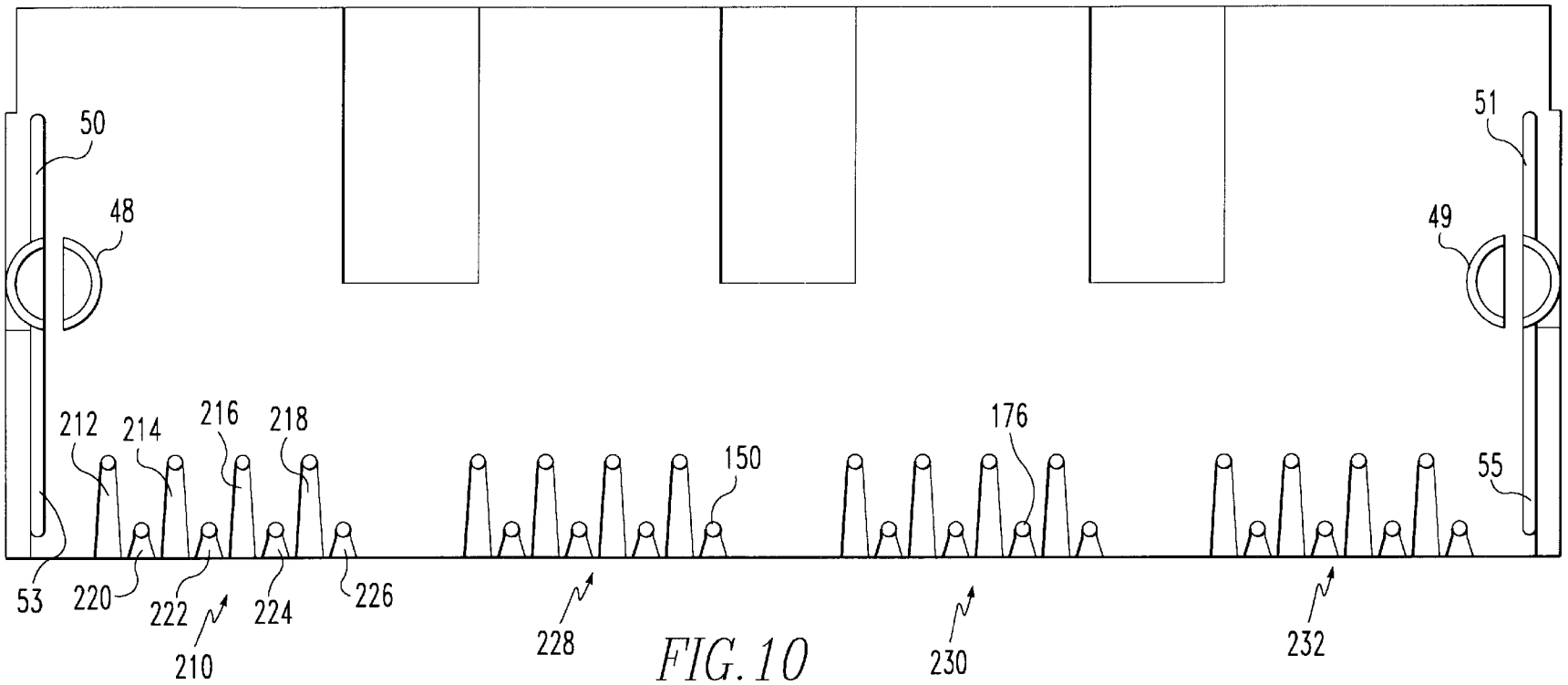
FIG. 10 is a bottom plan view of the modular jack assembly shown in FIG. 2.
Figure 11:
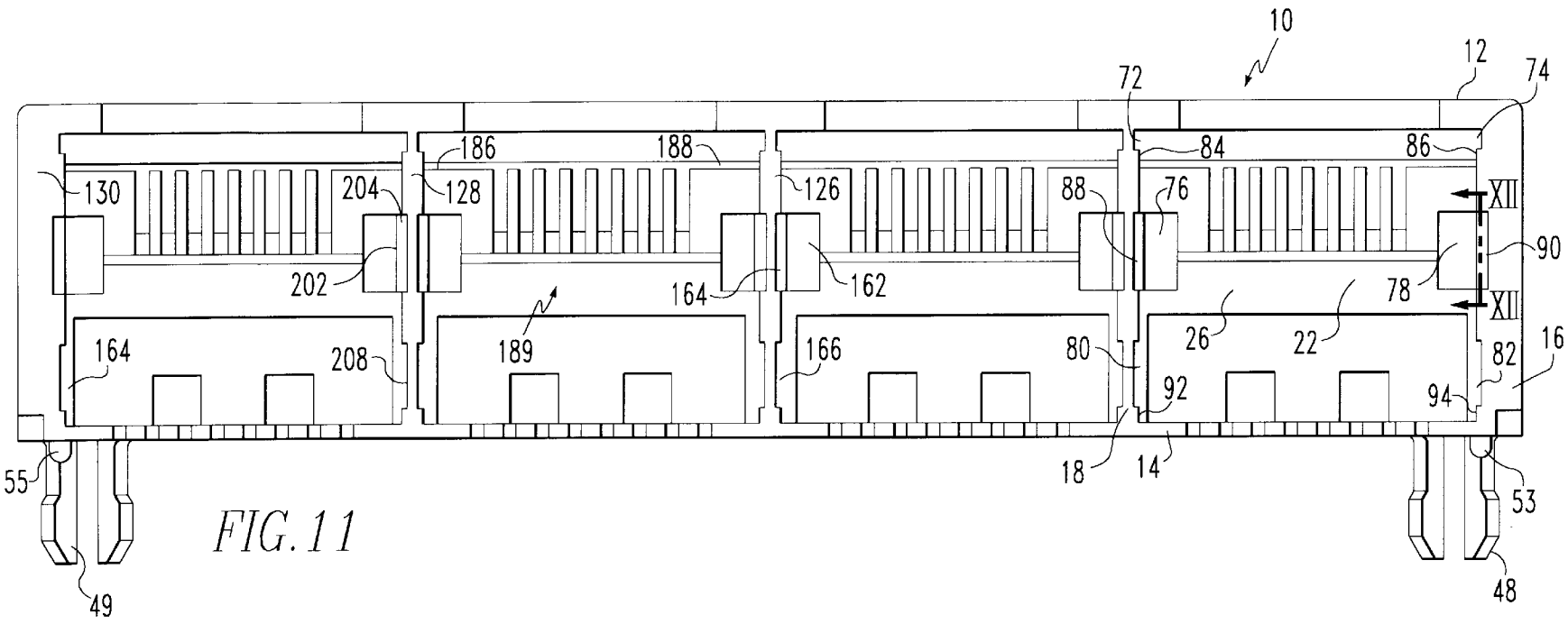
FIG. 11 is a rear elevational view of the insulated housing similar to that shown in FIG. 2 without insulated inserts.
Figure 13:
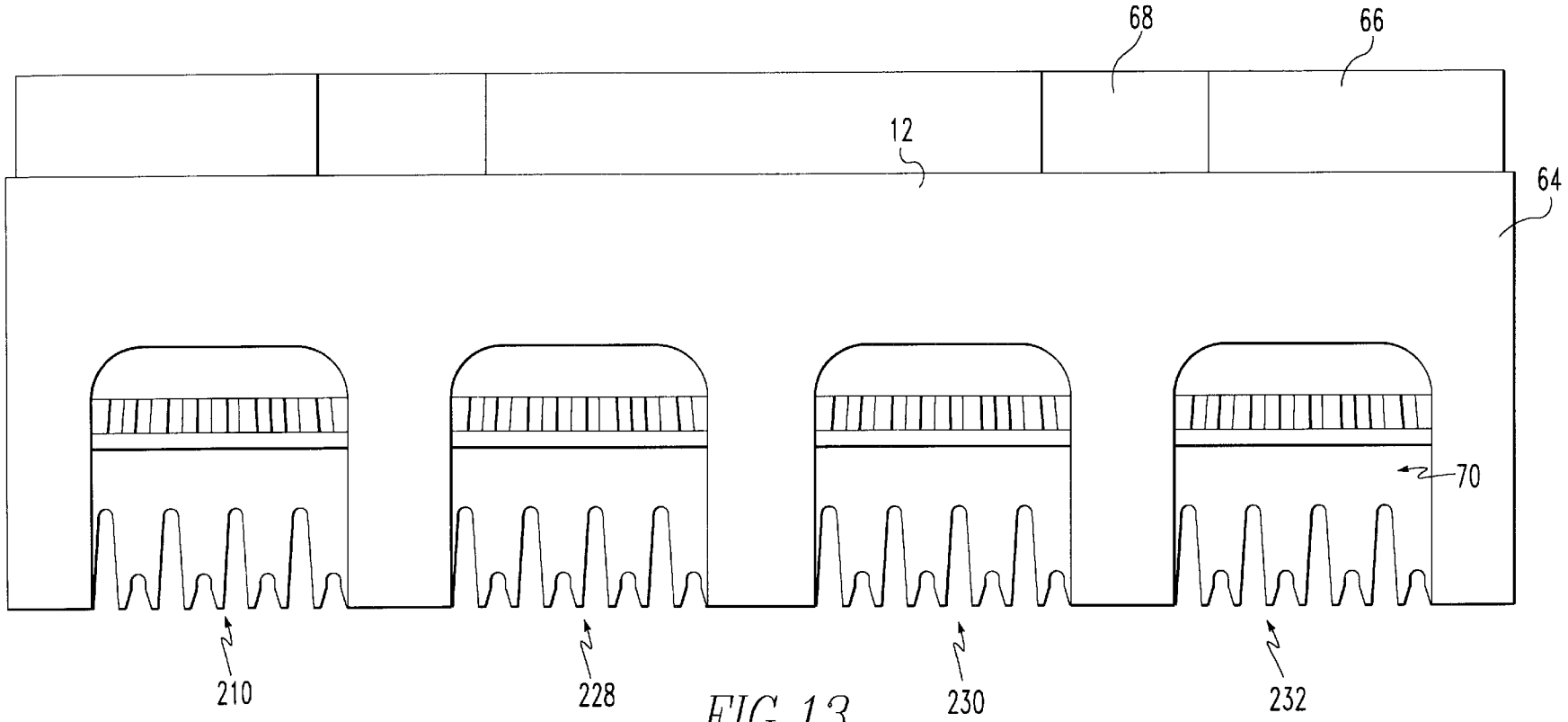
FIG. 13 is a top plan view of the insulated housing shown in FIG. 10.
Figure 14:
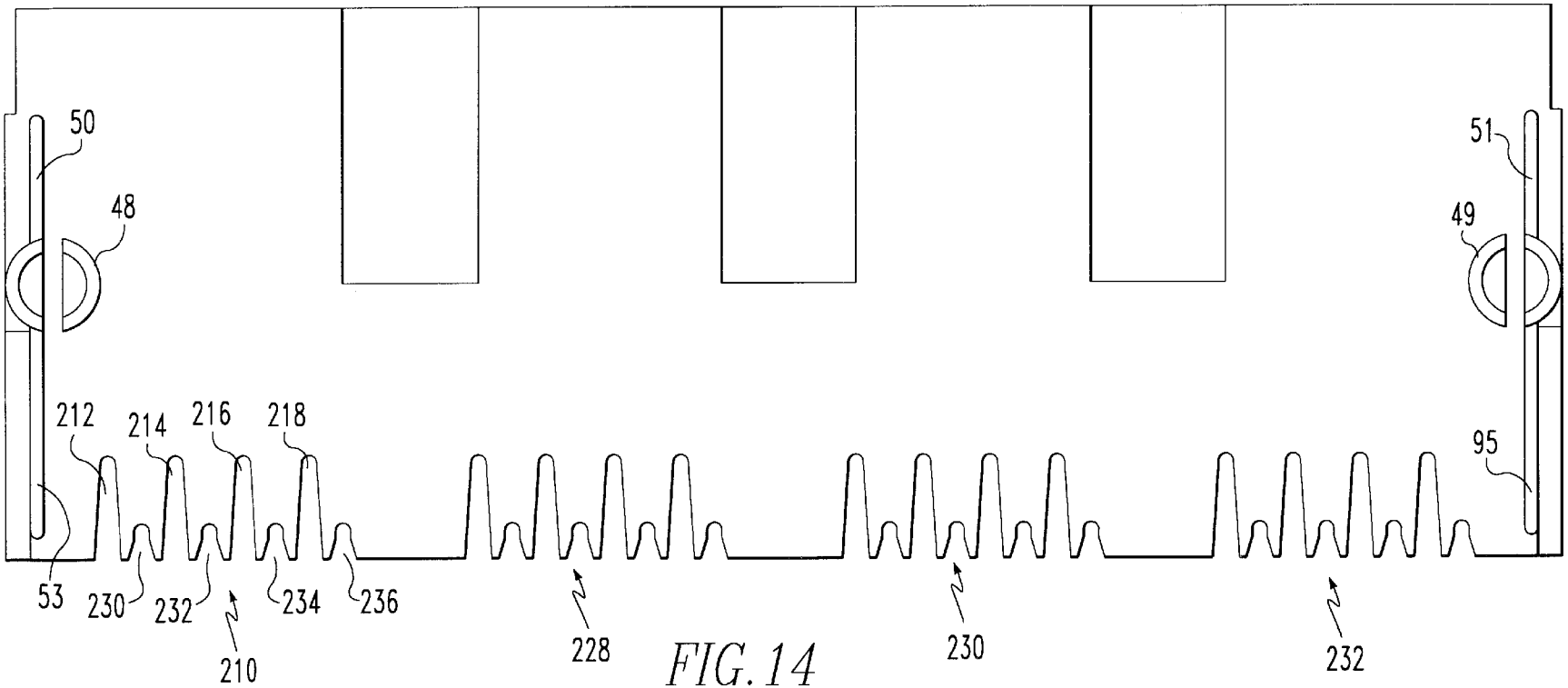
FIG. 14 is a bottom plan view of the insulated housing shown in FIG. 10.

Referring particularly to FIGS. 10, 11, and 13, it will be observed that there are on the lower wall of the insulative housing a number of combed structures which serve to position the wires in the insulative insert. A combed structure shown generally at numeral 210 serves to position the wires in the category 4 insulative insert 96 as structure is made up of a number of deep V-shaped grooves 212, 214, 216, and 218. There are also a number of shallow V-shaped grooves 220, 222, 224, and 226. By means of these V-shaped grooves, the wires in the insert need only be roughly aligned with the groove on insertion of the insert after which the V-shape of the insert allows for subsequent exact positioning. Other similar comb-like structures shown generally at numerals 228, 230, and 232 serve to align the wires in the category 5 insulative insert 138, the low cost filter insert 140, and the capacitive filter insert 142, respectively.

It will be appreciated that a modular jack assembly has been described which allows for single insulated housing to engage a variety of different types of insulated inserts in a economical and efficient manner. It will also be appreciated that this housing may be used in a multi-port housing embodiment to allow several different type of inserts to be used with the same housing.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack assembly comprising:

(a) an outer insulative housing having top and bottom walls and opposed lateral walls all defining an interior section and said housing also having front and rear open ends;

(b) an insulative insert having a first section superimposed over the rear open end of the insulative housing and a second section extending generally perpendicularly from the first section into the interior section of the housing and wherein said insulative insert has a base side and an upper side and a rear side on the first section and a terminal end on the second and a plurality of wires extend from said base side to said top side and then perpendicularly to said terminal end and then downwardly;

(c) means on the outer insulative housing for selectively engaging the insulative insert at either its first section or at its second section; and (d) wherein the wires extend downwardly from the base side and on the rear side of the bottom wall of insulative housing, there are a plurality of V-shaped grooves each of which grooves serves to initially align, then precisely position one of said wires as the insulative insert is engaged with the insulative housing and the wires are arranged in first and second parallel spaced rows and there are a first group of deeper V-shaped grooves and a second group of shallower V-shaped grooves and wires in the first row engage the first group of deeper V-shaped grooves and wires in the second row engage the second group of shallower V-shaped grooves.

2. The modular jack assembly of claim 1 wherein the insulative insert has latching means on its first section and said latching means engage the lateral walls of the outer insulative housing.

3. The modular jack assembly of claim 2 wherein there are parallel inner grooves on the side walls of the insulative housing and the latching means on the first section of the insulative insert engage said parallel grooves.

4. The modular jack assembly of claim 3 wherein projections extending laterally outwardly from the first section of the insulative insert engage projections on the side walls of the insulative housing extending laterally inwardly from the parallel inner grooves.

5. The modular jack assembly of claim 1 which is a multi-part jack assembly wherein adjacent said modular jack there is a second modular jack comprising:

(a) an outer insulative housing having top and bottom walls and opposed lateral walls all defining an interior section and said housing also having front and rear open ends;

(b) an insulative insert has a first section superimposed over the rear open end of the insulative housing and a second section extending generally perpendicularly from the first section into the interior section of the housing; and (c) means on the outer insulative housing for selectively engaging the insulative insert at either its first section or at its second section.

6. The modular jack assembly of claim 1 wherein said modular jack assembly is included in a plurality of similar modular jack assemblies positioned in side by side relation.

7. The modular jack assembly of claim 1 wherein the insulative insert is a category 4 jack.

8. The modular jack assembly of claim 7 wherein the insulative insert is engaged at its first section.

9. The modular jack assembly of claim 1 wherein the insulative insert is a category 5 jack.

10. The modular jack assembly of claim 9 wherein the insulative insert is engaged at its first section.

11. The modular jack assembly of claim 1 wherein the insulative insert is an inductive filter jack.

12. The modular jack assembly of claim 1 wherein the insulative insert is engaged at its first section.

13. The modular jack assembly of claim 1 wherein the insulative insert is a capacitive filter jack.

14. The modular jack assembly of claim 13 wherein the insulative insert is engaged at its first section.

* * * * *